US008417154B2

(12) United States Patent
Nieda

(10) Patent No.: US 8,417,154 B2
(45) Date of Patent: Apr. 9, 2013

(54) IMAGE FORMING APPARATUS WITH CONNECTING PORTION FOR SHAFT MISALIGNMENT

(75) Inventor: Hiroaki Nieda, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 729 days.

(21) Appl. No.: 12/559,078

(22) Filed: Sep. 14, 2009

(65) Prior Publication Data

US 2010/0209144 A1 Aug. 19, 2010

(30) Foreign Application Priority Data

Feb. 17, 2009 (JP) ..... 2009-033480

(51) Int. Cl.
*G03G 15/00* (2006.01)

(52) U.S. Cl.
USPC ..... 399/167

(58) Field of Classification Search ..... 399/167, 399/116

See application file for complete search history.

(56) References Cited

U.S. PATENT DOCUMENTS

| | | | | |
|---|---|---|---|---|
| 6,574,446 | B2 * | 6/2003 | Kitayama | 399/111 |
| 7,548,713 | B2 * | 6/2009 | Takigawa et al. | 399/167 |
| 7,817,938 | B2 * | 10/2010 | Igarashi | 399/119 |
| 7,822,364 | B2 * | 10/2010 | Takigawa et al. | 399/167 |
| 7,844,202 | B2 * | 11/2010 | Takigawa et al. | 399/167 |
| 7,869,735 | B2 * | 1/2011 | Hattori | 399/98 |
| 7,885,575 | B2 * | 2/2011 | Batori et al. | 399/111 |
| 8,103,192 | B2 * | 1/2012 | Takigawa et al. | 399/167 |
| 8,135,304 | B2 * | 3/2012 | Abe et al. | 399/111 |
| 2007/0042826 | A1 | 2/2007 | Furusawa | 464/120 |
| 2007/0122188 | A1 * | 5/2007 | Igarashi | |
| 2007/0196129 | A1 * | 8/2007 | Takigawa et al. | 399/167 |
| 2008/0152388 | A1 * | 6/2008 | Ueno et al. | 399/167 |
| 2008/0260428 | A1 * | 10/2008 | Ueno et al. | 399/167 |
| 2009/0196655 | A1 * | 8/2009 | Takigawa et al. | 399/167 |

FOREIGN PATENT DOCUMENTS

| | | | |
|---|---|---|---|
| JP | 60-249729 | | 12/1985 |
| JP | 2002-048148 | A | 2/2002 |
| JP | 2002328528 | A * | 11/2002 |
| JP | 2006-072160 | | 3/2006 |
| JP | 2006-139230 | A | 6/2006 |
| JP | 2006-163232 | A | 6/2006 |
| JP | 2007-51692 | A | 3/2007 |
| JP | 2007-069868 | | 3/2007 |
| JP | 2007-121774 | A | 5/2007 |
| JP | 2007-240007 | A | 9/2007 |

* cited by examiner

*Primary Examiner* — David Gray
*Assistant Examiner* — Laura Roth
(74) *Attorney, Agent, or Firm* — Morgan, Lewis & Bockius LLP

(57) ABSTRACT

An image forming apparatus is provided and includes: a rotating member; an engaging member to be removably engaged with the rotating member; a driving force transmitting member to be rotated and driven by a driving source; and a connecting portion that connects the engaging member to the driving force transmitting member so that the engaging member and the driving force transmitting member are movable in a misaligned direction and an axial direction. The connecting portion includes a connecting member, a pair of spherical members provided on respective ends of the connecting member, at least one of which is movable in the axial direction with respect to the engaging member and the driving force transmitting member, and a pair of fixing members that fix the pair of spherical members to the engaging member and the driving force transmitting member.

4 Claims, 12 Drawing Sheets

IMAGE FORMING APPARATUS WITH CONNECTING PORTION FOR SHAFT MISALIGNMENT

CROSS-REFERENCE TO RELATED APPLICATION

This application is based on and claims priority under 35 USC §119 from Japanese Patent Application No. 2009-033480 filed Feb. 17, 2009.

BACKGROUND (i) Technical Field

The present invention relates to an image forming apparatus.

(ii) Related Art

There has been known an image forming apparatus including a drive transmitting device for transmitting a driving force applied from a driving motor to a photosensitive member serving as a rotating member by using a gear or a belt.

SUMMARY

According to an aspect of the invention, there is provided an image forming apparatus including:

a rotating member;

an engaging member to be removably engaged with the rotating member;

a driving force transmitting member to be rotated and driven by a driving source; and a connecting portion that connects the engaging member to the driving force transmitting member so that the engaging member and the driving force transmitting member are movable in a misaligned direction and an axial direction, the connecting portion including a connecting member, a pair of spherical members provided on respective ends of the connecting member, at least one of which is movable in the axial direction with respect to the engaging member and the driving force transmitting member, and a pair of fixing members that fix the pair of spherical members to the engaging member and the driving force transmitting member.

BRIEF DESCRIPTION OF THE DRAWINGS

Embodiments of the present invention will be described in detail based on the following figures, wherein.

DETAILED DESCRIPTION

Figure 1:
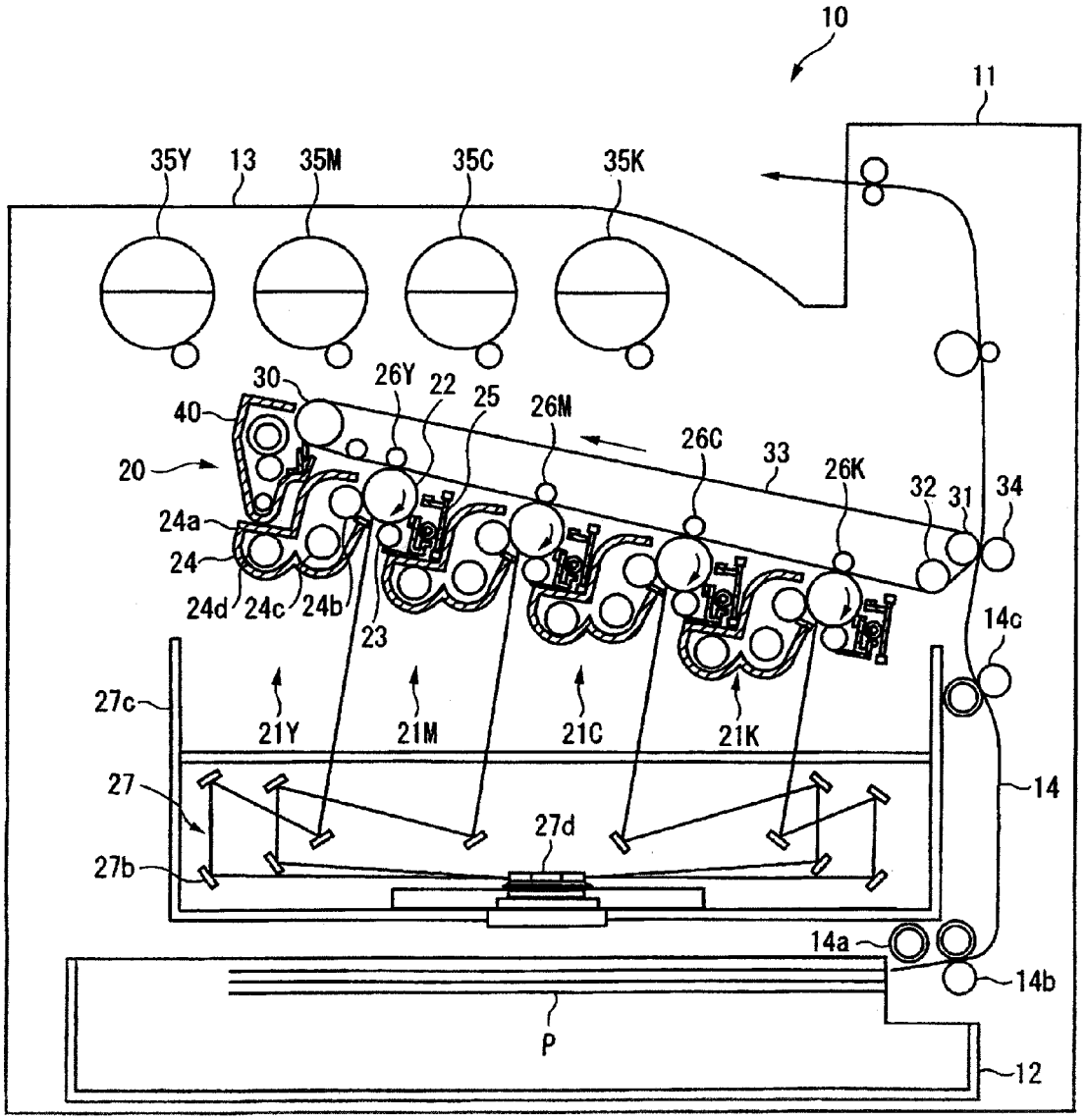
FIG. 1 is a view showing a schematic structure of an image forming apparatus according to an exemplary embodiment of the invention.

FIG. 1 is a view showing a schematic structure of an image forming apparatus according to an exemplary embodiment of the invention. An image forming apparatus 10 is a digital color printer, for example, and has such a structure as to carry out an image processing of image data transmitted from an upper device, for example a personal computer, with an image processing portion (not shown), converting the data into image data of respective colors of yellow (Y), magenta (M), cyan (C) and black (K), and to then form a color image on a paper based on the image data of the respective colors. The image forming apparatus 10 may be a copying machine, a facsimile machine, or a composite machine having the functions of a copying machine, a printer, a scanner and a facsimile machine.

The image forming apparatus 10 includes a housing 11 which is almost box-shaped, and a paper supplying tray 12 for accommodating a paper P to be a recording medium is removably provided on a lower part in the housing 11, a paper discharging portion 13 for discharging the paper P subjected to recording is provided on an upper part of the housing 11, and a paper feeding path 14 extending from the paper supplying tray 12 to the paper discharging portion 13 is formed. The paper feeding path 14 is provided with a pickup roll 14*a* for taking the paper P one sheet at a time from the paper supplying tray 12 into the paper feeding path 14, a correcting roll 14*b* for correcting a skew of the paper P, and a feeding roll 14*c* for feeding the paper P.

Moreover, the image forming apparatus 10 has an image forming portion 20 on a central part in the housing 11. The image forming apparatus 20 includes an intermediate transferring belt 33 stretched over a driving roll 30, a backup roll 31 and a driven roll 32 and circulated and moved in the direction of the arrow in the drawing, image forming units 21Y, 21M, 21C and 21K disposed removably at a certain interval from each other on the outside of the intermediate transferring belt 33 and having a photosensitive member 22 serving as a rotating member on which toner images for respective colors of Y, M, C and K are formed while rotating in the direction of the arrow in the drawing, and primary transferring rolls 26Y, 26M, 26C and 26K which are disposed inside of the intermediate transferring belt 33 and which cause a toner image formed on a surface of the photosensitive member 22 to be transferred to the intermediate transferring belt 33.

The image forming units 21Y, 21M, 21C and 21K have the same structures. Each of the image forming units 21Y, 21M, 21C and 21K includes the photosensitive member 22, a charging device 23 for uniformly charging the surface of the photosensitive member 22, a developing device 24 for developing, with a toner, an electrostatic latent image formed on the surface of the photosensitive member 22 by an exposing device 27 and thus form a toner image on the surface of the photosensitive member 22, and a photosensitive member cleaning portion 25 for collecting the toner remaining on the surface of the photosensitive member 22.

The developing device 24 has a housing 24*a* for accomodating the toner, and the housing 24*a* includes a developing roll 24*b* for supplying a toner to the photosensitive member 22 and developing, with the toner, the electrostatic latent image formed on the photosensitive member 22, a supplying auger 24*c* for supplying the toner to the developing roll 24*b*, and a stirring auger 24*d* for stirring the toner and supplying the toner to the supplying auger 24*c*. Toners having the respective colors are supplied from toner boxes 35Y, 35M, 35C and 35K to the developing device 24.

The exposing device 27 includes four semiconductor lasers (not shown) for emitting laser beams modulated according to image data of the respective colors of Y, M, C and K, a polygon mirror 27*a* for branching the laser beam emitted from each of the semiconductor lasers, and a plurality of mirrors 27*b* for reflecting the laser beam branched by the polygon mirror 27*a* to irradiate the photosensitive member 22, thereby forming an electrostatic latent image on the surface of the photosensitive member 22. The exposing device 27 is sealed by a frame 27*c* so as not to be contaminated with the toner. An upper part of the frame 27*c* is transparent glass.

The image forming portion 20 is provided with a secondary transferring roll 34 facing the backup roll 31 with the intermediate transferring belt 33 interposed therebetween, and a toner image on the intermediate transferring belt 33 is secondarily transferred to the paper P in a nip region formed by the secondary transferring roll 34 and the backup roll 31.

In the image forming portion 20, moreover, a belt cleaning portion 40 is provided facing the driving roll 30 with the intermediate transferring belt 33 interposed therebetween, upstream of the image forming unit 21Y. The belt cleaning portion 40 is pressed toward the driving roll 30 side, and scrapes away and collects the toner remaining on the intermediate transferring belt 33.

Figure 2:
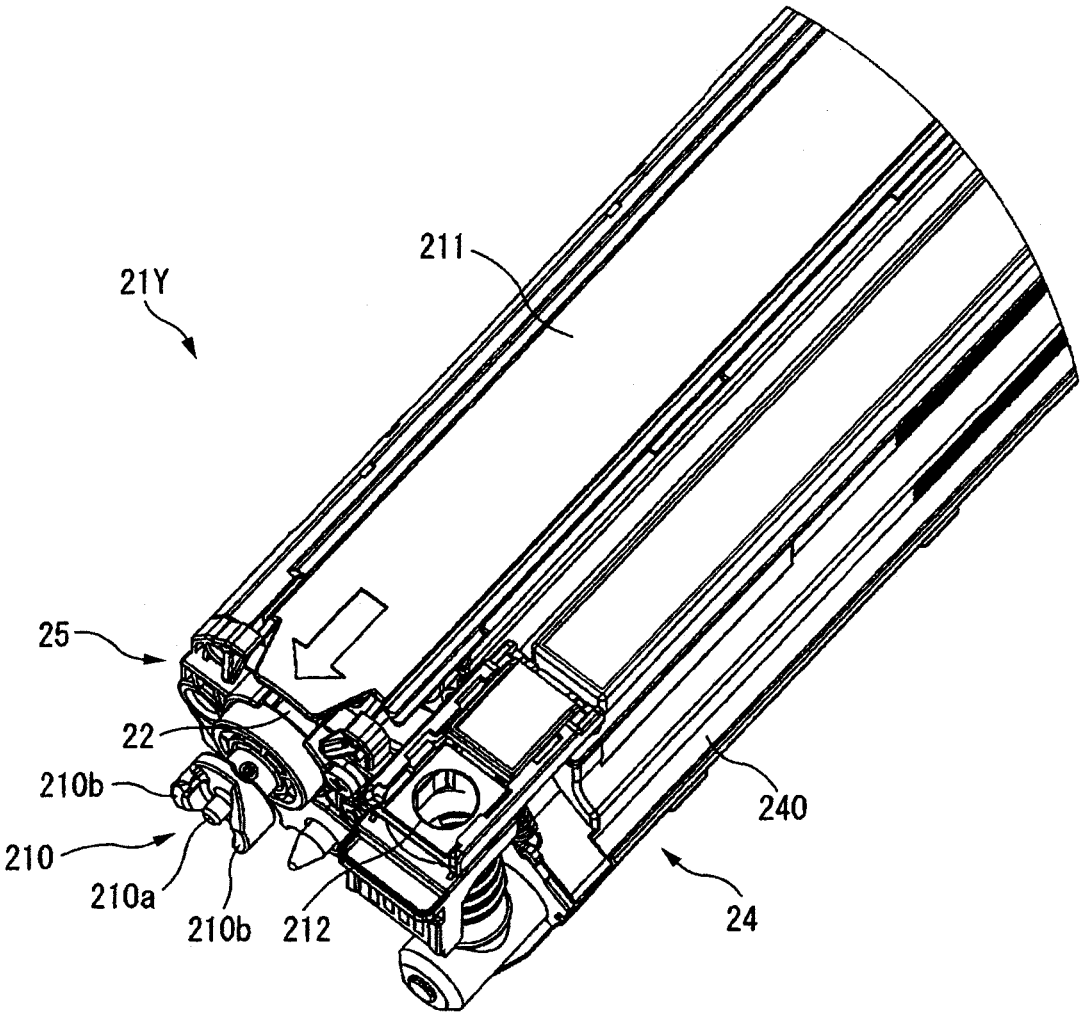
FIG. 2 is a perspective view showing a main part of an image forming unit.

FIG. 2 is a perspective view showing a main part of the image forming unit. Since the image forming units 21Y, 21M, 21C and 21K have the same structures, the image forming unit 21Y will be described as an exemplary embodiment. The image forming unit 21Y has a coupling member 210 connected to a coupling member of a photosensitive member rotation driving device which will be described below, a cover 211 for protecting the photosensitive member 22, and a hole opening portion 212 to which the toner is supplied from the toner box 35Y. The cover 211 is constituted to be slid and removed from the image forming unit 21Y when attaching the image forming unit 21Y to the housing 11. The coupling member 210 has a shaft 210*a* which is attached to a rotating shaft of the photosensitive member 22 and is coaxial with the rotating center of the photosensitive member 22, and a pair of locking portions 210*b* disposed around the shaft 210*a*.

Figure 3:
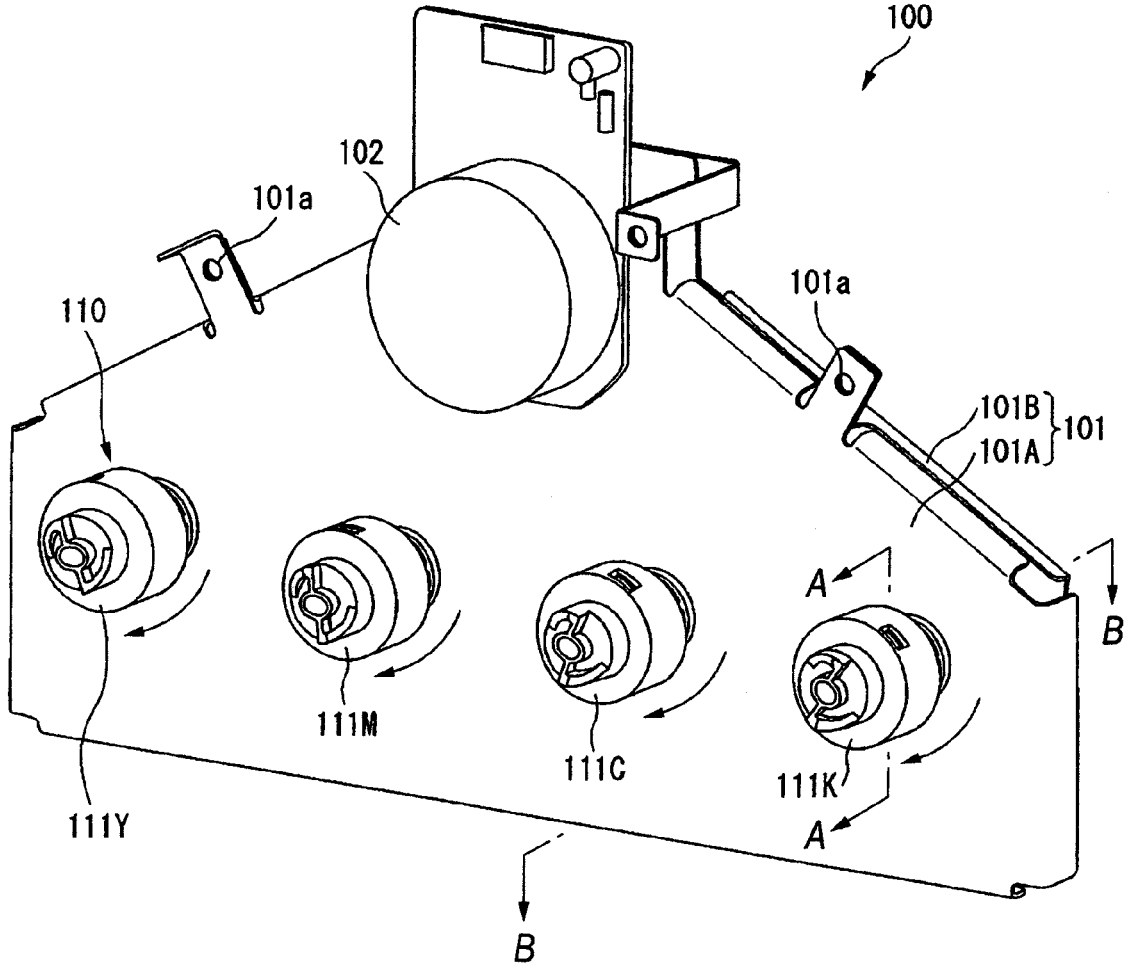
FIG. 3 is a perspective view showing an appearance of a photosensitive member rotation driving device.

FIG. 3 is a perspective view showing the appearance of the photosensitive member rotation driving device. A photosensitive member rotation driving device 100 includes a case 101 having a coupling side case portion 101A and a non-coupling side case portion 101B. A motor 102 serving as a driving source and four coupling portions 110 to which the coupling members 210 of the photosensitive members 22 is connected are provided on the coupling side of the case 101. The photosensitive member rotation driving device 100 is attached to the housing 11 at the non-coupling side of the image forming units 21Y, 21M, 21C and 21K with screws through attaching holes 101*a* of the coupling side case 101A. The coupling portion 110 includes coupling members 111Y, 111M, 111C and 111K and a spring receiving member which will be described below. In the following description, each of the coupling members 111Y, 111M, 111C and 111K will be generally referred to as a coupling member 111.

Figure 4:
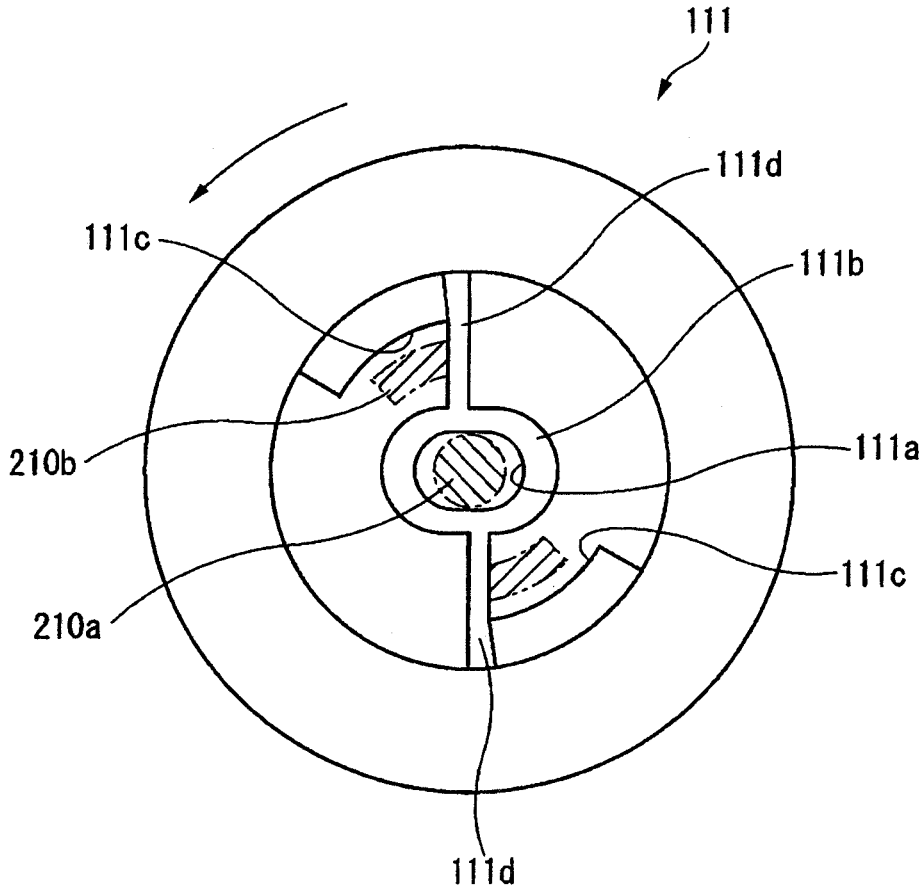
FIG. 4 is a front view showing a coupling member of the photosensitive member rotation driving device.

FIG. 4 is a front view showing the coupling member 111 of the photosensitive member rotation driving device 100. The coupling member 111 includes an elliptical protruded portion 111*b* having within it a slot 111*a* in which the shaft 210*a* of the coupling member 210 shown in FIG. 2 is fitted. Moreover, an L shape is formed by an engaging portion 111*c* with which the locking portion 210*b* of the coupling member 210 is engaged and a protruded portion 111*d* formed extending from the side of the elliptical protruded portion 111*b*. The coupling member 111 is rotated in the direction of the arrow in FIG. 4 so that the locking portion 210*b* on the photosensitive member 22 side is engaged with the engaging portion 111*c*.

Figure 5:
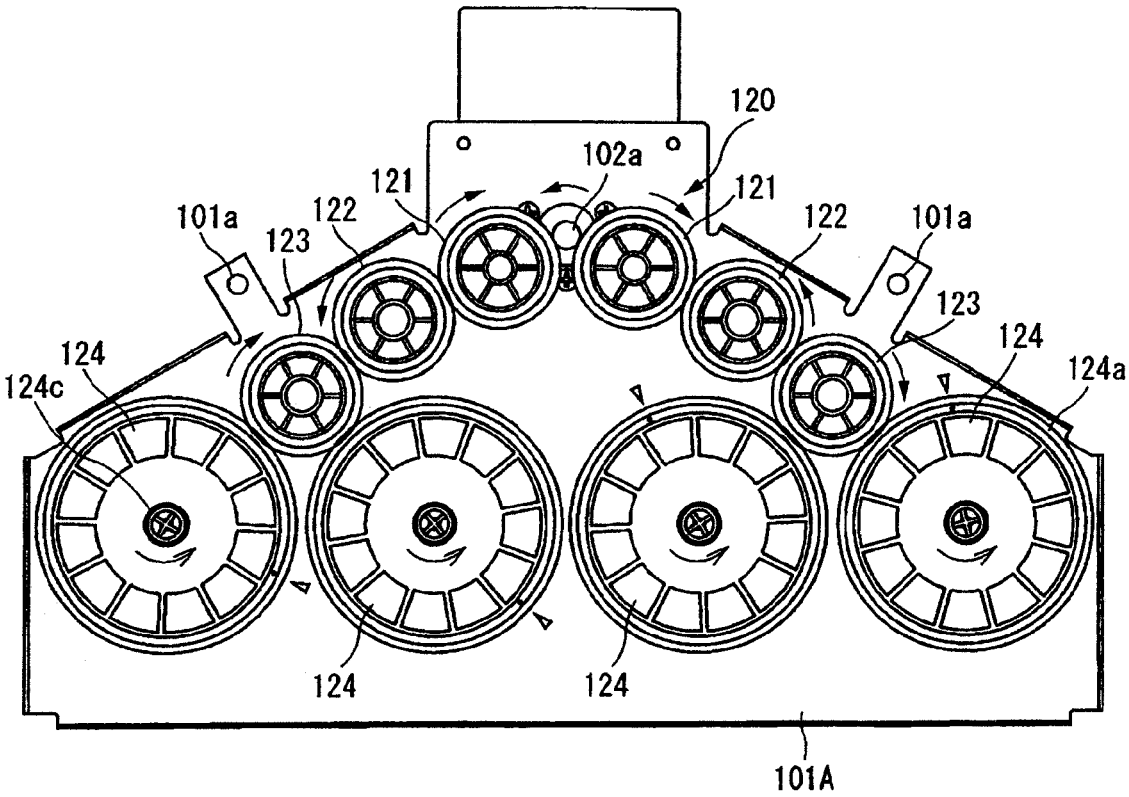
FIG. 5 is a front view showing an inside of a coupling side case as seen from the rear.

FIG. 5 is a front view showing the inside of the coupling side case 101A as seen from the non-coupling side. A gear train 120 to be rotated and driven by the motor 102 is accommodated in the case 101 as shown in FIG. 5. The gear train 120 is constituted by a pair of left and right first gears 121 engaged with an output gear 102*a* provided on the output shaft of the motor 102, a pair of left and right second gears 122 engaged with the pair of left and right first gears 121 respectively, a pair of left and right third gears 123 engaged with the pair of second gears 122, a pair of left and right fourth gears 124 serving as driving force transmitting members and engaged with one of the third gears 123, and a pair of left and right fourth gears 124 to be engaged with the other third gear 123. The fourth gear 124 is coupled to the coupling portion 110 shown in FIG. 3 through a coupling portion which will be described below.

Figure 6:
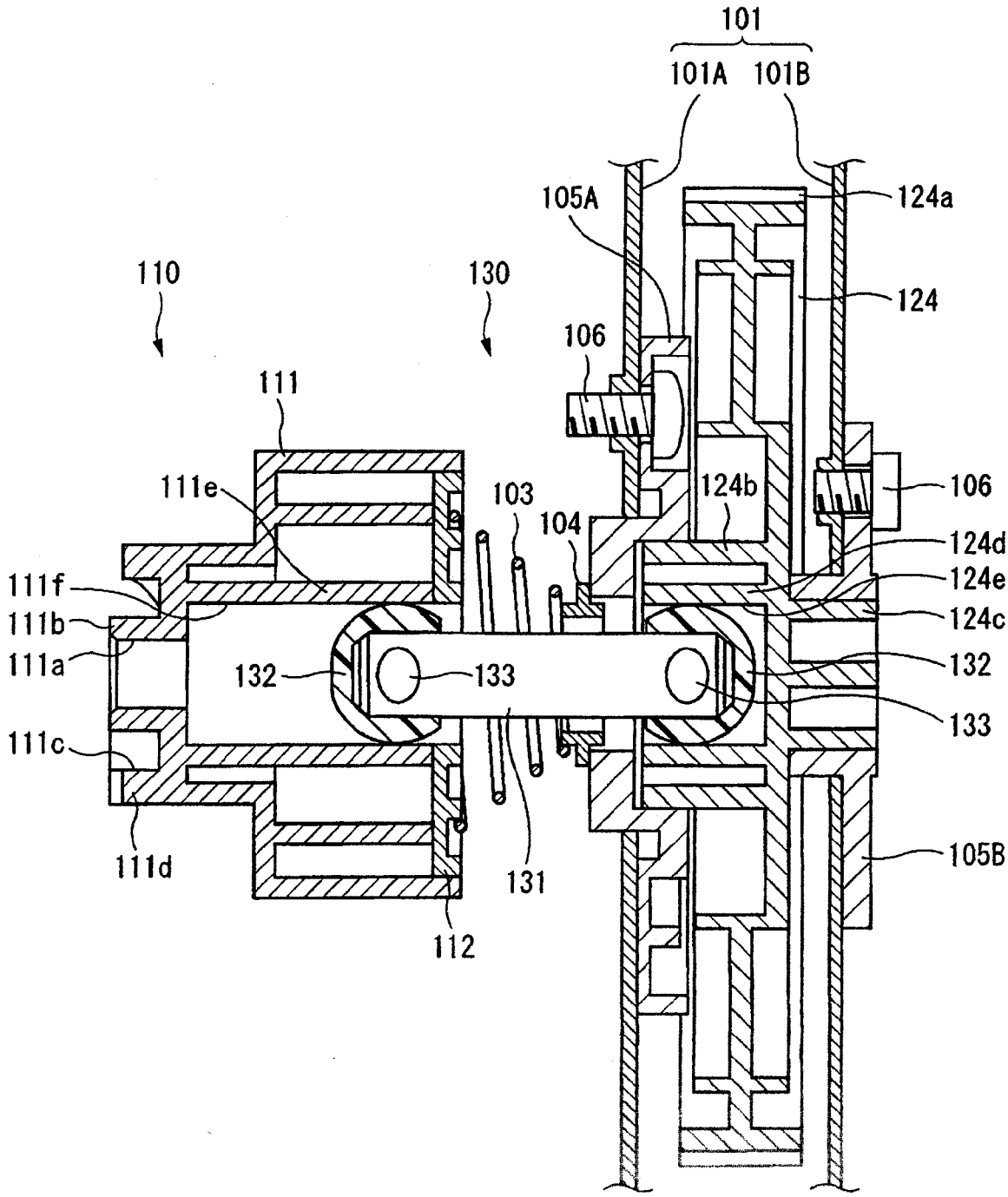
FIG. 6 is a sectional view taken along the A-A line in FIG. 3.

FIG. 6 is a sectional view taken along the A lines in FIG. 3. The coupling portion 110 and the fourth gear 124 are connected to each other through a connecting portion 130 movably in misaligned and axial directions. A coil spring 103 and a washer 104 are disposed between the coupling portion 110 and the fourth gear 124.

The connecting portion 130 includes a shaft 131 serving as a connecting member or a pole-shaped member, a pair of spherical members 132 which are provided on both ends of the shaft 131 and are movable in an axial direction with respect to the coupling member 111 and the fourth gear 124, and a pair of pins 133 serving as fixing members or protruded members which fix the pair of spherical members 132 with respect to a rotating direction of the coupling member 111 and the fourth gear 124. Even if rotating shaft axes of the coupling member 111 and the fourth gear 124 which will be described below are misaligned, if the coupling member 111 and the fourth gear 124 contact each other through spherical members 132, the shapes of the other portions may be selected as appropriate and there will be no problem.

The fourth gear 124 has formed around its central axis teeth 124*a* formed on the gear circumferential surface, and a shaft portion 124*b* supported rotatably at side toward the coupling side case 101A, a shaft portion 124*c* supported rotatably on the side toward non-coupling side case portion 101B, and a spherical member housing portion 124*d* for accommodating the spherical member 132 so that it can move in the axial direction which are formed on a rotating central axis. A hole 124*e* is formed in the spherical member housing portion 124*d*. The hole 124*e* has a slightly greater inside diameter than the outside diameter of the spherical member 132.

In the fourth gear 124, the shaft portion 124*b* is rotatably supported at the coupling side case 101A by a supporting member 105A and the shaft portion 124*c* is rotatably supported at the non-coupling side case 101B by a supporting member 105B. The supporting member 105A is attached to the coupling side case 101A with a screw 106, and the supporting member 105B is attached to the non-coupling side case 101B with a screw 106.

The coupling portion 110 comprises the coupling member 111 and a spring receiver 112 which is an elastic member fixed to the coupling member 111 and which receives the coil spring 103. The coil spring 103 biases the coupling portion 110 away from the case 101.

The coupling member 111 includes a spherical member housing portion 111*e* along whose axis the spherical member 132 is inserted and accommodated movably. A hole 111*f* is formed in the spherical member housing portion 111*e*. The hole 111*f* has a slightly greater inside diameter than the outside diameter of the spherical member 132.

Figure 7:
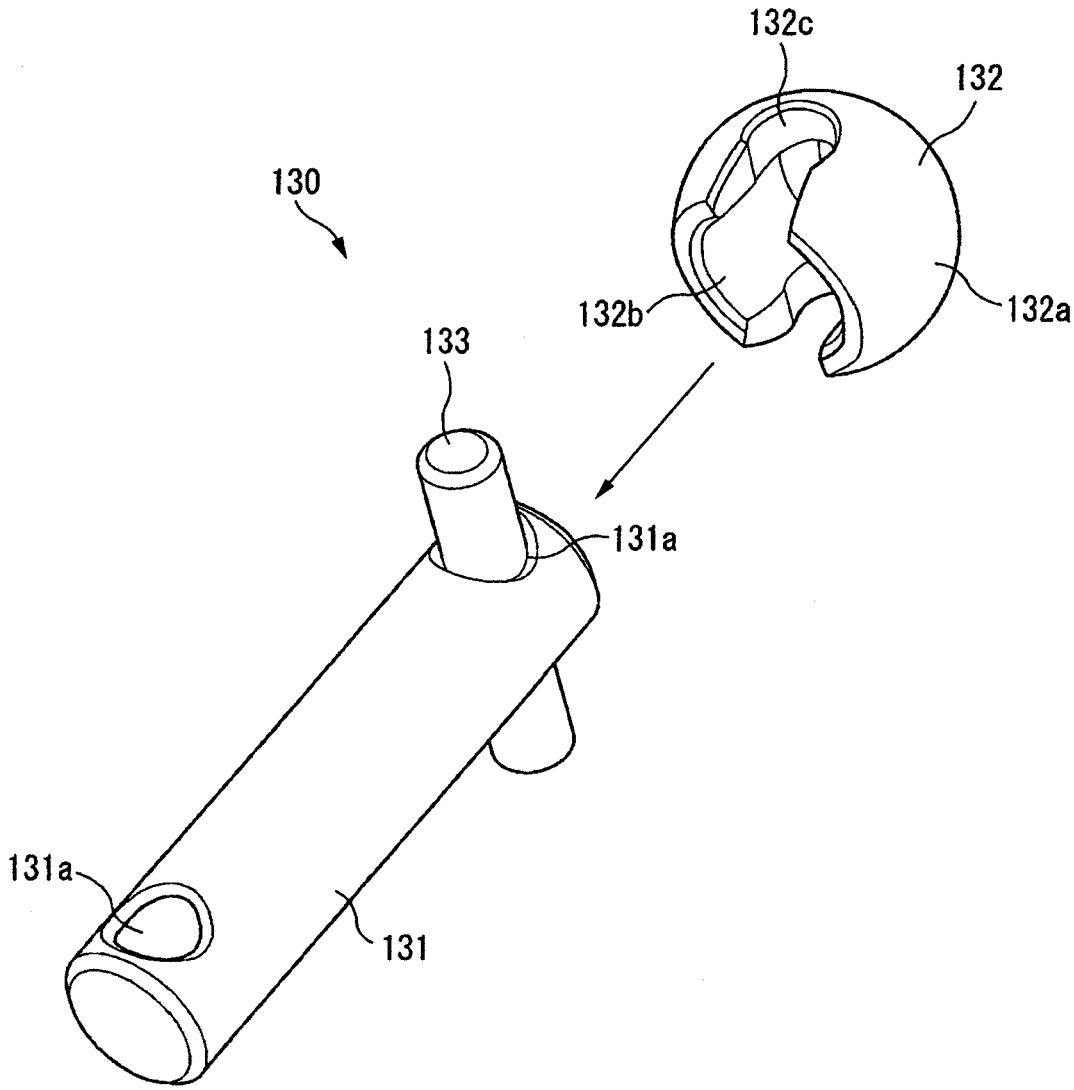
FIG. 7 is an exploded perspective view showing a connecting portion.

FIG. 7 is an exploded perspective view showing the connecting portion 130. The spherical member 132 has a part 132*a* whose surface is part of a sphere, and there are formed a hole 132*b* in which the shaft 131 is fitted and a groove 132*c* in which the pin 133 is fitted. The shaft 131 is cylindrical and has through holes 131*a* formed on both ends. The connecting portion 130 is assembled by fitting the pins 133 in the through holes 131*a* on both ends of the shaft 131 and fitting the spherical member 132 around an end of the shaft 131 and the pin 133. The spherical member 132 has a smaller outside diameter than the length in the axial direction of the pin 133, and is formed from a resin in order to easily carry out fitting around the end of the axis 131 and the pin 133. Although the shaft 131, the pin 133 and the spherical member 132 are constituted by three different members in the embodiment, two of the three members or all three members may be formed integrally into a single member.

Figure 8:
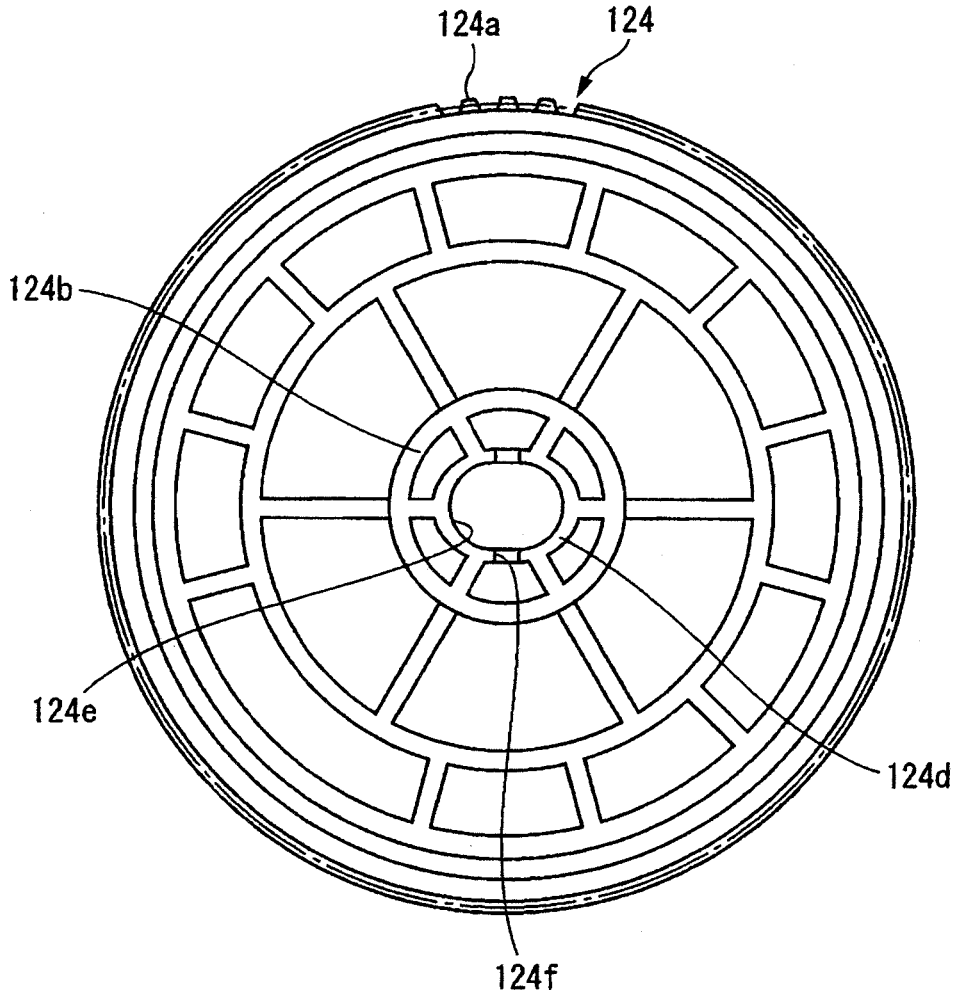
FIG. 8 is a front view showing a fourth gear.

FIG. 8 is a front view of the fourth gear 124. The fourth gear 124 has a pair of grooves 124*f* formed on the spherical member housing portion 124*d*. The pin 133 of the connecting portion 130 is fitted in the groove 124*f*. The pin 133 of the connecting portion 130 is fitted in the groove 124*f* of the fourth gear 124 so that a rotating force of the fourth gear 124 is transmitted to the shaft 131 through the pin 133.

Figure 9:
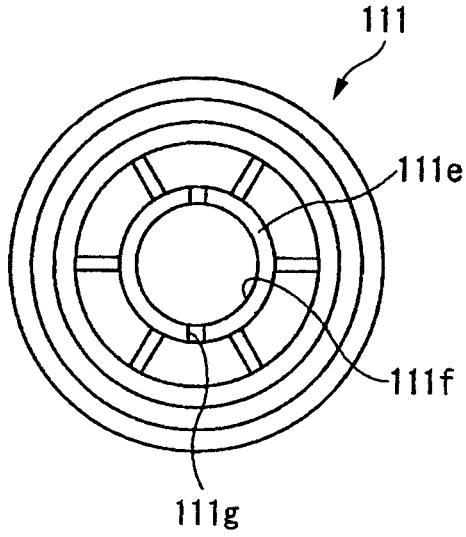
FIG. 9 is a front view showing the coupling member illustrated in FIG. 3 as seen from the case side.

FIG. 9 is a front view showing the coupling member 111 illustrated in FIG. 3 as seen from the case 101 side. In the coupling member 111, a groove 111*g* for fitting the pin 133 of the connecting portion 130 is formed on the spherical member housing portion 111*e*. The pin 133 of the connecting portion 130 is fitted in the groove 111*g* of the coupling member 111 so that a rotating force of the shaft 131 is transmitted to the coupling member 111 through the pin 133.

(Operation of Photosensitive Member Rotation Driving Device)

Figure 10:
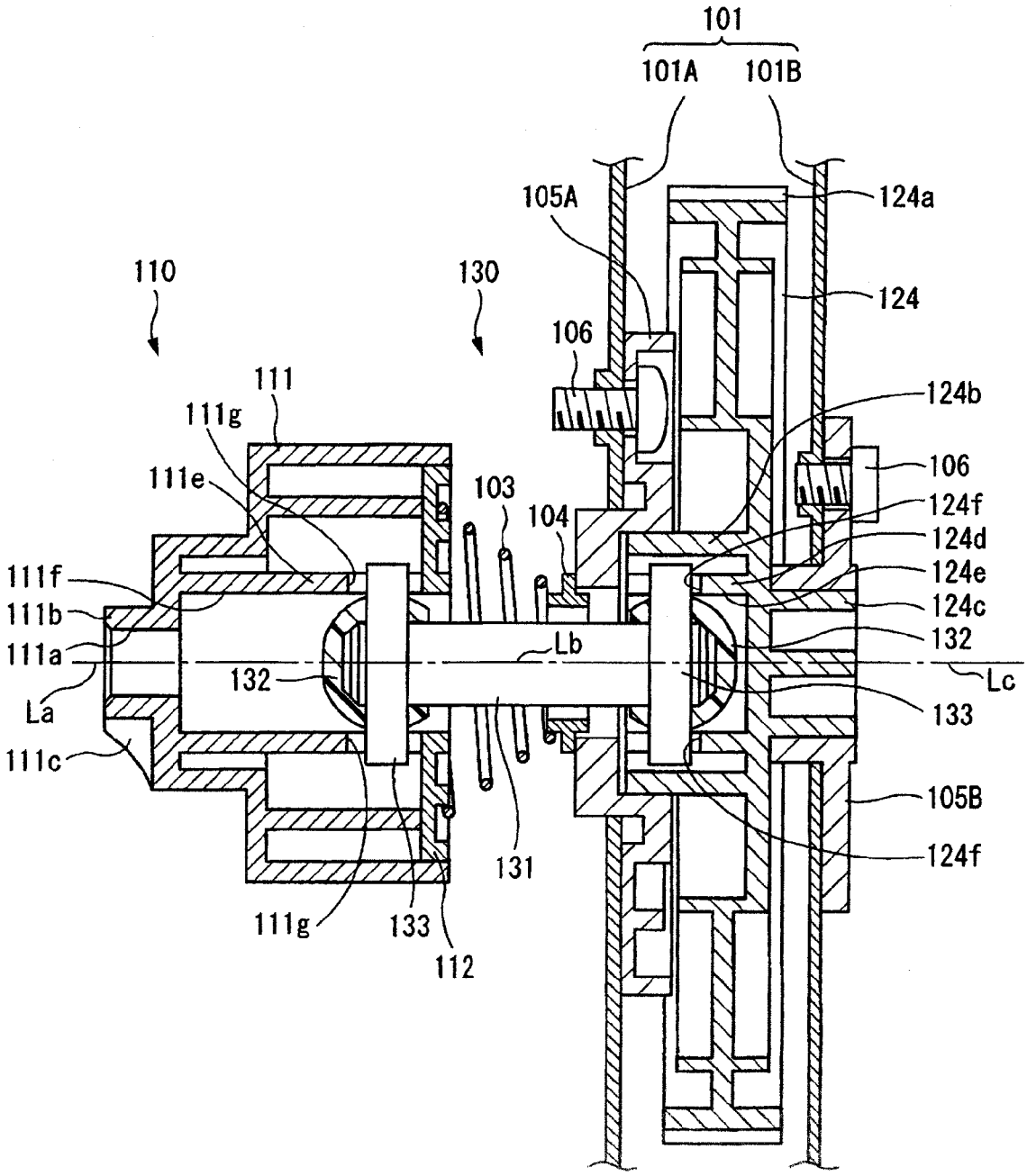
FIG. 10 is a sectional view taken along the B - B line in FIG. 3, illustrating a state in which a shaft misalignment between the fourth gear and a coupling portion has not occurred.
Figure 11:
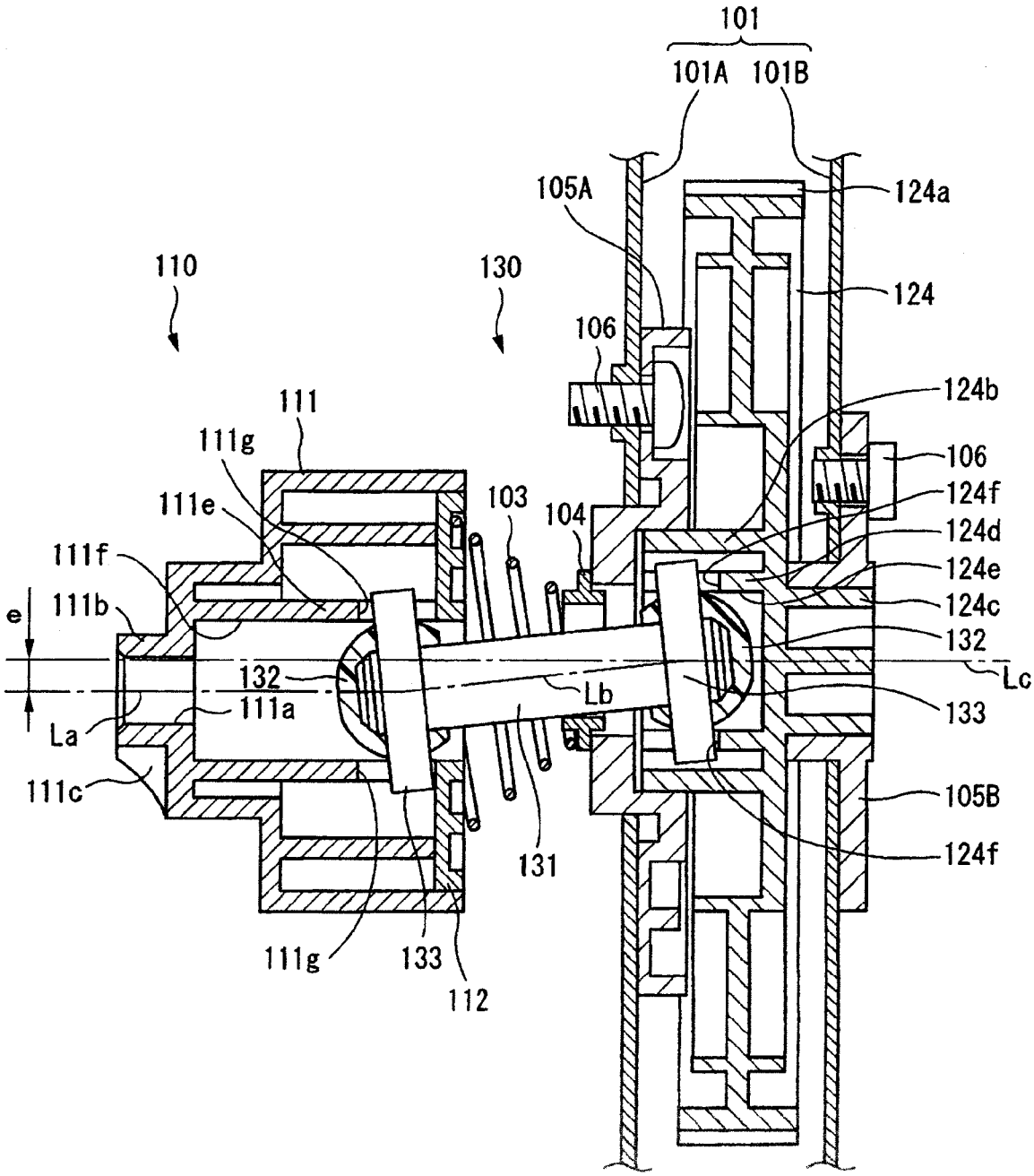
FIG. 11 is a sectional view taken along the B - B line in FIG. 3, illustrating a state in which a shaft misalignment between the fourth gear and the coupling portion has occurred.

FIG. 10 is a sectional view taken along a B-B line in FIG. 3, illustrating a state in which a shaft misalignment is not caused between the fourth gear 124 and the coupling portion 110, and FIG. 11 is a sectional view taken along the B-B line in FIG. 3, illustrating a state in which the shaft misalignment is caused between the fourth gear 124 and the coupling portion 110. An operation of the photosensitive member rotation driving device 100 will be described below with reference to FIGS. 10 and 11.

When the motor 102 of the photosensitive member rotation driving device 100 is driven by a control of a controlling portion which is not shown, a rotating force of the motor 102 is transmitted from the output gear 102*a* provided on the output shaft of the motor 102 to the first gear 121 of the gear train 120, and then is transmitted to the four fourth gears 124 through the second gears 122 and the third gears 123. The rotating force transmitted to the fourth gear 124 is transmitted to the coupling portion 110 through the connecting portion 130. The image forming units 21Y, 21M, 21C and 21K connected to the coupling portion 110 are rotated at the same time in the same direction.

The toner images formed on the photosensitive members 22 of the image forming units 21Y, 21M, 21C and 21K are transferred onto the intermediate transferring belt 33, and furthermore, are transferred onto the paper P so that a color image having little register misalignment is formed.

As shown in FIG. 10, in the state in which the shaft misalignment is not caused between the fourth gear 124 and the coupling portion 110, rotating axes La, Lb and Lc of the fourth gear 124, the shaft 131 of the connecting portion 130, and the coupling portion 110, respectively, are coaxial. In this case, the angular speed of the fourth gear 124 is maintained to be constant as it is transmitted to the shaft 131 of the connecting portion 130 and the coupling portion 110.

As shown in FIG. 11, in the state in which shaft misalignment is caused between the fourth gear 124 and the coupling portion 110, the rotating axis La of the fourth gear 124 is misaligned with the rotating axis Lc of the coupling portion 110 by a shift amount e. The rotating axis Lb of the shaft 131 of the connecting portion 130 is tilted with respect to the other rotating axes La and Lc. In this case, the angular speed of the fourth gear 124 changes by an amount corresponding to the tilt angle of the shaft 131 at the fourth gear 124 side of the connecting portion 130. However, this change is canceled out by the change in angular speed which occurs at the coupling portion 110 side connecting portion 130, so that the coupling portion 110 has the same angular speed as the fourth gear 124.

Figure 12:
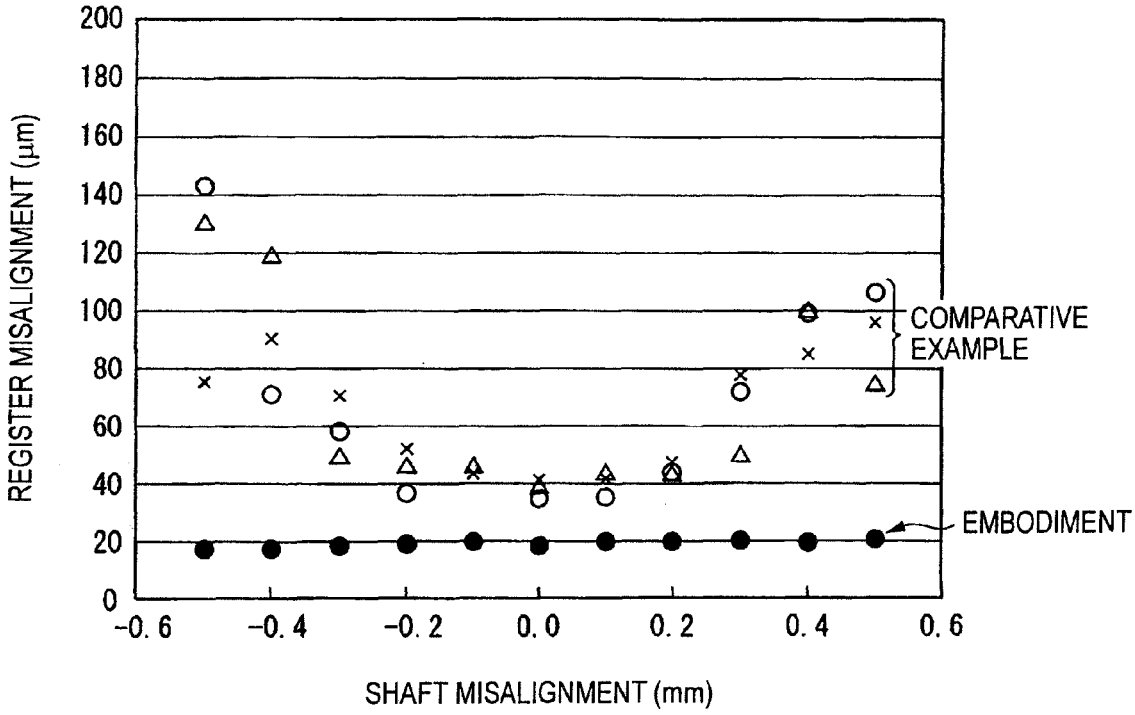
FIG. 12 is a chart showing measurements of register misalignment of the embodiment and a comparative example.

FIG. 12 shows measurements of the register misalignment in the embodiment and in a comparative example. In the configuration of the comparative example, the spherical member was omitted and the ends of the shaft 131 were connected to the coupling member and the fourth gear through a single pivot shaft each. The register misalignment indicates the color shift of the toner image for each of Y, M, C and K. From FIG. 12, it is apparent that the register misalignment is increased with an increase in the shaft misalignment in the comparative example, and that the register misalignment hardly changes at all even if the shaft misalignment is increased in the embodiment.

The invention is not restricted to the embodiment, and various changes can be made without departing from the scope of the invention. For example, although the photosensitive member has been described as the rotating member in the embodiment, the rotating member of the invention may be a developing roll in a developing device, a feeding roll for delivering a paper, a roll for moving an intermediate transferring belt or other rotating members Although both of the spherical members 132 can be moved in the axial direction with respect to the coupling member 111 and the fourth gear 124 in the embodiment, it is also possible to employ a structure in which they can be moved in the axial direction with respect to one of these.

What is claimed is:

1. An image forming apparatus comprising:

a rotating member;

an engaging member to be removably engaged with the rotating member;

a driving force transmitting member to be rotated and driven by a driving source; and a connecting portion that connects the engaging member to the driving force transmitting member so that the engaging member and the driving force transmitting member are movable in an misaligned direction and an axial direction, the connecting portion including a connecting member, a pair of spherical members provided on respective ends of the connecting member, at least one of which is movable in the axial direction with respect to the engaging member and the driving force transmitting member, and a pair of fixing members that fix the pair of spherical members to the engaging member and the driving force transmitting member, further comprising an elastic member disposed between the engaging member and the driving force transmitting member and serving to bias the engaging member away from the driving force transmitting member.

2. The image forming apparatus according to claim 1, wherein the connecting member is a pole-shaped member, the fixing members are protruding members provided at respective ends of the pole-shaped member and protruding in a radial direction from the pole-shaped member, and each of the spherical members has a smaller outside diameter than a length of one of the protruding members, and the protruding members protrude from respective surfaces of the spherical members attached to the respective ends of the pole-shaped member.

3. The image forming apparatus according to claim 2, wherein the spherical member is made of a resin, has a hole which the pole-shaped member is fitted into and a groove which the fixing member is fitted into, and is assembled by fitting the spherical member around an end of the pole-shaped member and the fixing member.

4. An image forming apparatus comprising:

a plurality of photosensitive members;

a plurality of engaging members to be removably engaged with the photosensitive members;

a plurality of driving force transmitting members to be rotated and driven by a driving source; and a plurality of connecting portions that connect the engaging members to the driving force transmitting members so that the engaging members and the driving force transmitting members are movable in a misaligned direction and an axial direction, each of the connecting portions including a connecting member, a pair of spherical members provided on respective ends of each of the connecting members, at least one of which is movable in the axial direction with respect to the engaging members and the driving force transmitting members, and a pair of fixing members that fix the pair of spherical members to the engaging members and the driving force transmitting members, further comprising an elastic member disposed between the engaging members and the driving force transmitting members and serving to bias the engaging members away from the driving force transmitting members.

* * * * *